US012281528B2

(12) United States Patent
Shaffer et al.

(10) Patent No.: US 12,281,528 B2
(45) Date of Patent: Apr. 22, 2025

(54) QUICK CONNECT SETTING KIT AND METHOD

(71) Applicant: GEODYNAMICS, INC., Millsap, TX (US)

(72) Inventors: Raymond Christopher Shaffer, Burleson, TX (US); Jeremy Eli Castaneda, Weatherford, TX (US); Kevin George, Cleburne, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/329,233

(22) Filed: May 25, 2021

(65) Prior Publication Data

US 2021/0372212 A1 Dec. 2, 2021

Related U.S. Application Data

(60) Provisional application No. 63/032,810, filed on Jun. 1, 2020.

(51) Int. Cl.
*E21B 23/06* (2006.01)
*E21B 33/129* (2006.01)
*E21B 17/042* (2006.01)

(52) U.S. Cl.
CPC ..... *E21B 23/06* (2013.01); *E21B 33/1293* (2013.01); *E21B 17/042* (2013.01)

(58) Field of Classification Search
CPC ..... E21B 23/06; E21B 33/1293
See application file for complete search history.

(56) References Cited

U.S. PATENT DOCUMENTS

| | | | | |
|---|---|---|---|---|
| 2,872,238 | A * | 2/1959 | Daffin | E21B 31/18 294/86.18 |
| 3,473,609 | A * | 10/1969 | Allen | E21B 33/16 137/71 |
| 3,673,289 | A * | 6/1972 | Gagliani | C08J 7/08 264/28 |
| 3,866,681 | A * | 2/1975 | Shirley | E21B 33/13 166/387 |
| 3,927,583 | A * | 12/1975 | Parsons | B23Q 7/043 279/142 |
| 4,553,421 | A * | 11/1985 | Provost | B21D 39/04 72/402 |
| 6,257,331 | B1 * | 7/2001 | Blount | E21B 23/06 166/123 |
| 6,708,768 | B2 | 3/2004 | Slup et al. | |
| 7,942,098 | B2 | 5/2011 | Han et al. | |
| 9,845,651 | B2 | 12/2017 | McCoy et al. | |
| 10,488,163 | B2 | 11/2019 | Collins et al. | |
| 10,605,040 | B2 | 3/2020 | Hardesty et al. | |

(Continued)

FOREIGN PATENT DOCUMENTS

WO WO-2019221805 A1 * 11/2019 ..... E21B 23/01

*Primary Examiner* — D. Andrews
*Assistant Examiner* — Ronald R Runyan
(74) *Attorney, Agent, or Firm* — Morgan, Lewis & Bockius LLP

(57) ABSTRACT

A setting kit for connecting a plug to a setting tool includes a collet connecting part configured to be attached to an internal sleeve of the setting tool; and a collet configured to be attached with a first end to the collet connecting part and with a second end to the plug. The second end automatically connects to the plug by only pushing the second end onto the plug.

13 Claims, 9 Drawing Sheets

(56) References Cited

U.S. PATENT DOCUMENTS

| | | | | |
|---|---|---|---|---|
| 11,028,666 | B2 * | 6/2021 | Sommers | E21B 33/129 |
| 2002/0189820 | A1 * | 12/2002 | Slup | E21B 33/1204 166/123 |
| 2003/0188860 | A1 * | 10/2003 | Zimmerman | E21B 23/04 166/123 |
| 2015/0247376 | A1 * | 9/2015 | Tolman | E21B 33/1208 166/57 |
| 2016/0138363 | A1 * | 5/2016 | Sommers | E21B 33/129 166/138 |
| 2019/0153807 | A1 | 5/2019 | Barlow | |
| 2019/0234177 | A1 | 8/2019 | Silva et al. | |
| 2021/0372206 | A1 * | 12/2021 | Shaffer | E21B 17/0423 |

* cited by examiner

PRIOR ART

PRIOR ART

QUICK CONNECT SETTING KIT AND METHOD

BACKGROUND

Technical Field

Embodiments of the subject matter disclosed herein generally relate to a setting tool quick connect element that is used for perforating well operations, and more specifically, to a setting tool quick connect element that attaches without screws to a plug for setting the plug in a well.

Discussion of the Background

After a well is drilled and cased, a fluid connection needs to be established between the bore of the casing and the formations outside the well. One or more perforation guns are used for this purpose, i.e., to make holes through the casing to establish the fluid connection between the bore and the formations. The perforation guns may be lowered into the well together with a setting tool and a plug. The setting tool sets the plug at a desired level inside the well, and then the perforating guns are fired to establish perforations into the casing, i.e., to achieve the fluid connection between the bore of the casing and the formations. Next, a fracturing fluid is pumped into the well and into the formations, through the perforations, to fracture the formations. Because of the plug, the fracturing fluid is forced through the perforations of a given stage and cannot reach other stages. This means that a plug needs to be set for each stage.

A typical setting tool/plug system 100 is illustrated in FIG. 1A and includes a setting kit 120, the setting tool 110 and the plug 130. The setting kit 120 is configured to connect the plug 130 to the setting tool 110. The setting kit 120 includes an internal sleeve 112 and an external sleeve 114, that encloses the internal sleeve 112. These sleeves connect to corresponding sleeves of the setting tool. The plug 130 has a mandrel 132 that defines a bore 134. Various elements are distributed along the mandrel 132, for example, a top push ring 136, an upper slip ring 138, an upper wedge 140, a sealing element 142, a lower wedge 144, a lower slip ring 146, a bottom push ring 148, and a mule shoe 150. The top push ring 136 becomes in direct contact with the external sleeve 114 while the bottom push ring 148 is attached with screws 149 to the internal sleeve 112. When the setting tool is activated, the external sleeve of the setting tool presses against the top push ring while the internal sleeve of the setting tool holds still through the internal sleeve of the setting kit the bottom push ring. The setting tool is typically activated by an explosive charge that causes a piston to be driven inside the setting tool, which in turn activates either the external sleeve or the internal sleeve. The movement of this piston is used for sliding one of the internal sleeve or the external sleeve relative to the other sleeve and consequently setting the plug.

This opposite motion of the internal and external sleeves 112 and 114 makes the wedges 140 and 144 to push away the corresponding slip rings 138 and 146, to engage the casing (not shown) of the well while also compressing the sealing element 142. This motion results in the slip rings pressing strongly against the casing, which prevents the entire plug to slip relative to the casing due to the high friction developed between these elements, and also results in the sealing element sealing the bore of the casing, and thus preventing a fluid from moving past the plug.

After the plug has been set, the internal sleeve of the setting kit breaks out from the bottom push ring and thus, the setting tool with the setting kit detaches from the plug, so that the setting tool together with the perforating guns can be removed from the well. The plug is left behind and seals the casing of the well at that location. Thus, a fracturing operation can now begin. After the plugged stage is fractured, the above noted operations are repeated to deploy a new plug, to insulate a new stage, and to perforate and fracture the new stage to further establish a fluid connection between the interior of the casing and the formations.

An alternative mode of coupling the setting tool to the plug is shown in FIG. 1B, where the internal sleeve 112 is directly attached, with screws 149, to a proximal end of the mandrel 132, which means that the internal sleeve 112 does not extend all the way through the bore 134 of the mandrel, as in the case illustrated in FIG. 1A. However, even for this case, screws 149 are used to connect the mandrel to the internal sleeve. The screws 149 are designed in both cases to break when a certain force is applied, which is selected to be larger than the force necessary to set the plug.

The operation of attaching the plug 130 to the setting tool 110 in the above cases may result in incorrectly attaching the plug to the setting kit, or failing to fully attach the plug to the setting kit as the holes that are made in the setting kit to receive the screws 149 wear off in time and cannot be reused. Thus, there is a need to have a novel way to connect a setting kit to a plug so that there is only one way to connect these elements, and also to avoid the presence of holes or screws for connecting these parts to each other to extend their useful life.

SUMMARY

According to an embodiment, there is a setting kit for connecting a plug to a setting tool. The setting kit includes a collet connecting part configured to be attached to an internal sleeve of the setting tool and a collet configured to be attached with a first end to the collet connecting part and with a second end to the plug. The second end automatically connects to the plug by only pushing the second end onto the plug.

According to another embodiment, there is a system for connecting a plug to a setting tool with a setting kit. The system includes the plug, which is configured to seal a bore of casing in a well and the setting kit. The setting kit has a collet that automatically engages and locks onto the plug by only pushing the collet onto the plug, and the setting kit is configured to attach to an internal sleeve of the setting tool.

According to yet another embodiment, there is a method for connecting a plug to a setting tool before being deployed in a well. The method includes providing a plug having a mandrel, the mandrel having a ring that extends around and away from the mandrel, attaching a collet connecting part to a collet, attaching the collet to the ring of the plug by only pushing the collet onto the plug, sliding the collet connecting part, while connected to the collet and the plug, inside an external sleeve, and rotating the plug to attach threads of the collect connecting part to an internal sleeve of the setting tool.

BRIEF DESCRIPTON OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a setting kit that attaches a setting tool to a plug for well exploration. However, the embodiments discussed herein are applicable to any tool that needs to be attached to another tool, in a well, with no screws.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a setting kit for attaching a plug to a setting tool includes a collet having a thread at one end and plural fingers at an opposite end. The threaded end connects to the setting tool while the plural fingers automatically connect to the plug. No screws are used for these connections and thus, no holes need to be made either in the plug or in the setting kit for this purpose. The plural fingers of the collet automatically connect to a ring situated on the plug, by pushing the fingers over the ring. The setting kit may be used with any existing setting tool. In one embodiment, which is discussed next, a Baker 20 setting tool is taken as an example of the setting tool. However, those skilled in the art would understand that any other setting tool may be used similarly for connecting it to the plug. The plug used in this embodiment is a fracturing plug, also called a frac plug. However, other plugs may also be used with the discussed setting kit.

Figure 1A:
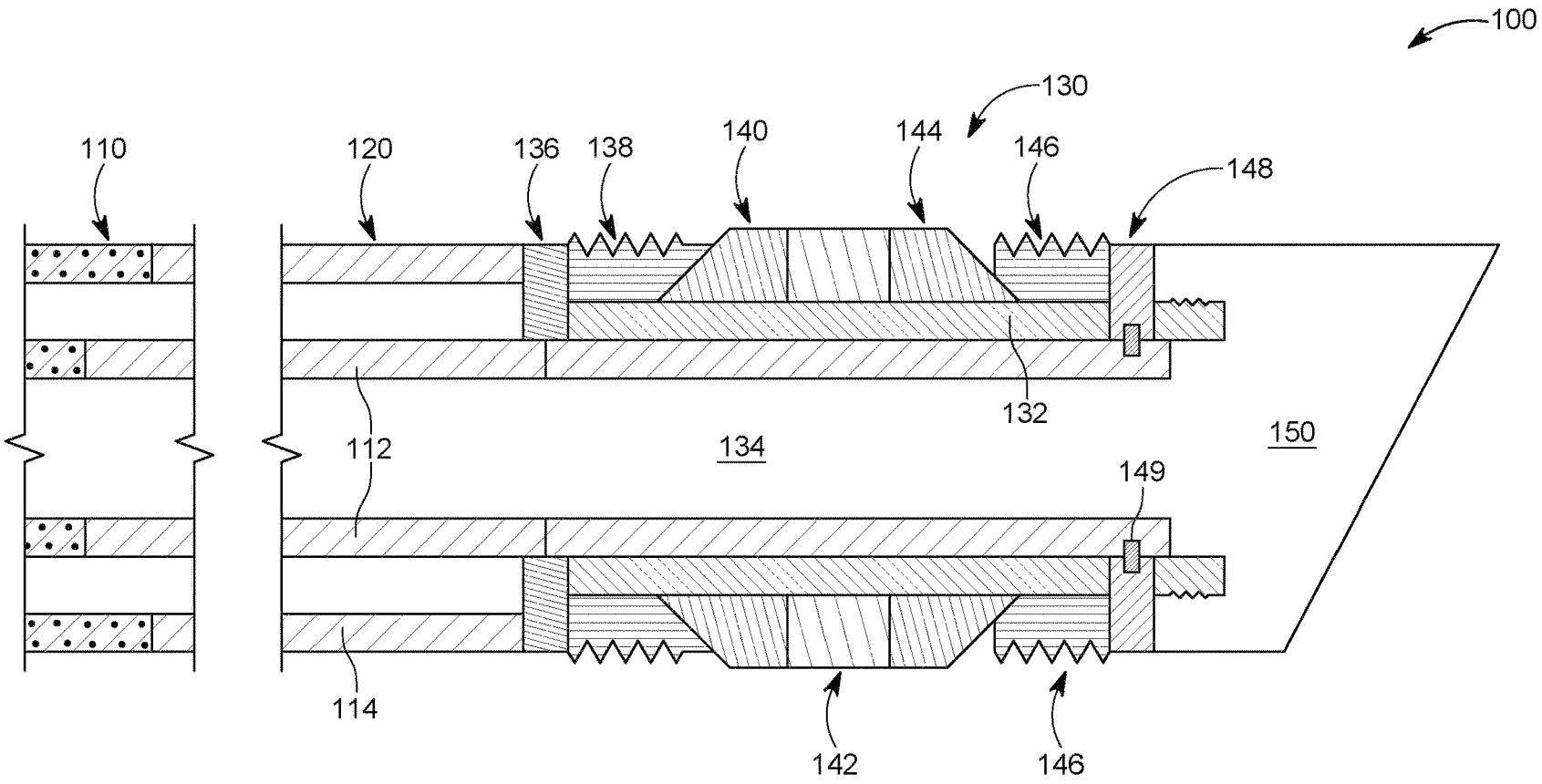
FIG. 1A illustrates a traditional setting kit that is connected to bottom of a plug with plural screws.
Figure 1B:
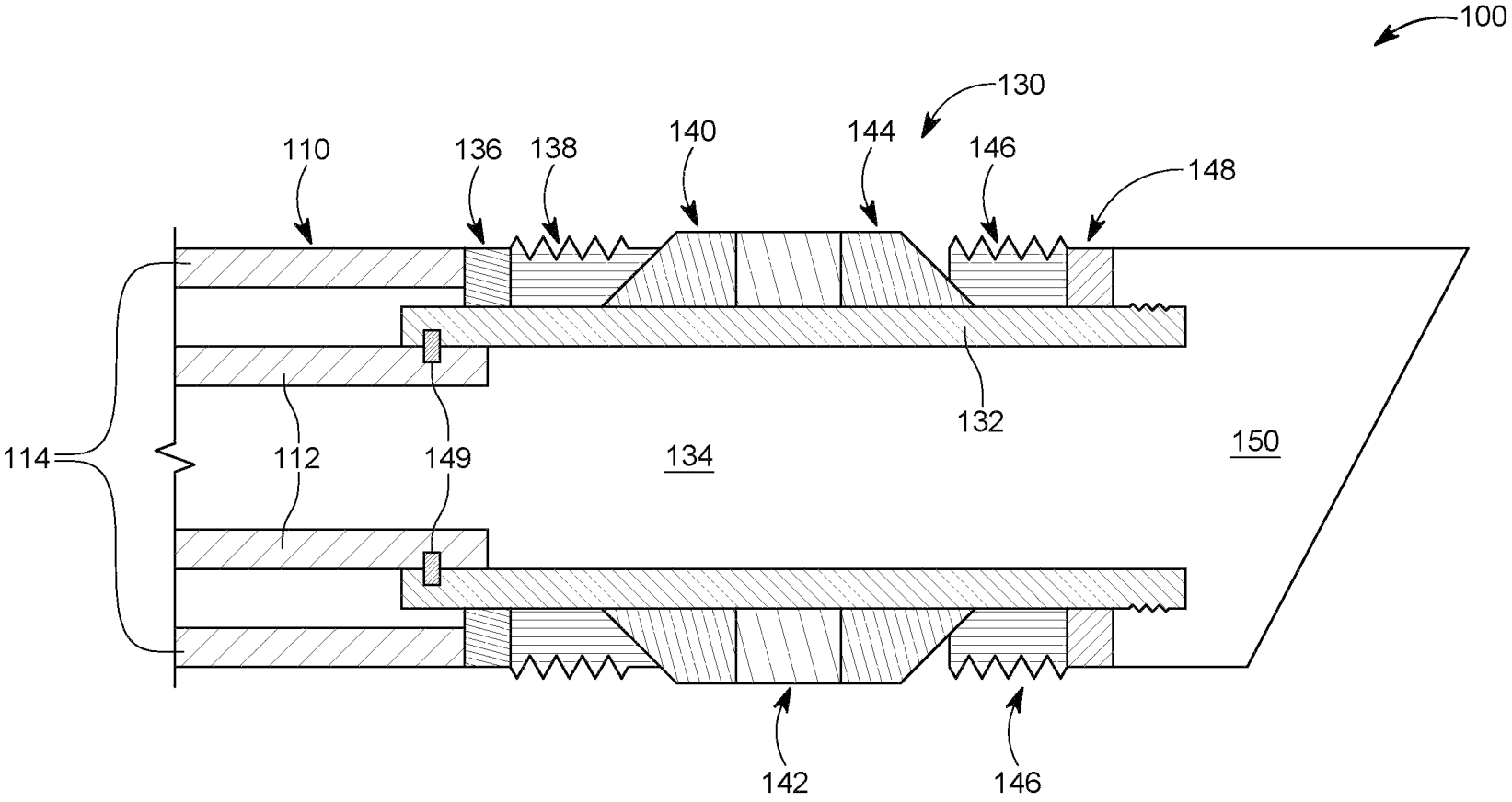
FIG. 1B illustrates a traditional setting kit that is connected to a top of a plug with plural screws.
Figure 2:
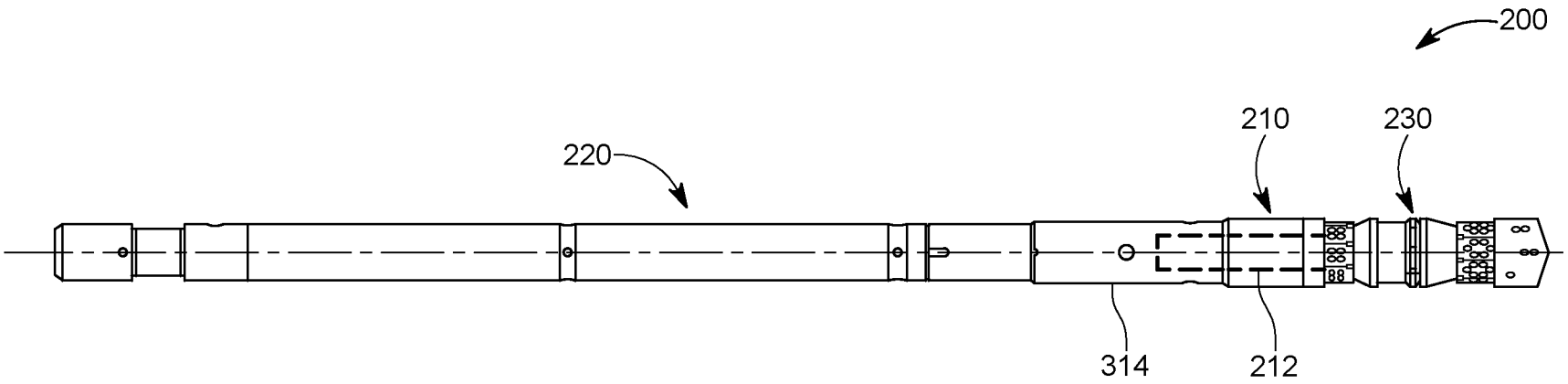
FIG. 2 illustrates a system that uses a setting kit to connect the setting tool to a plug with no screws.

According to the embodiment shown in FIG. 2, a setting kit 210 is provided between a setting tool 220 and a plug 230 for achieving a mechanical connection between these elements. FIG. 2 shows such a system 200 in which the setting kit 210 has an external sleeve 314 and a collet connecting part 212, which is fully located inside the external sleeve 314, and for this reason the setting kit 210 is shown as having the collet connecting part 212 with a dash line. As noted above, the setting tool 220 may be any known setting tool. For simplicity of explanation, the setting tool 220 in this embodiment is considered to have the internal and external sleeves shown in FIGS. 1A and 1B. However, the plug 230 is modified to be different from the plug 130 previously shown, as discussed later.

Figure 3:
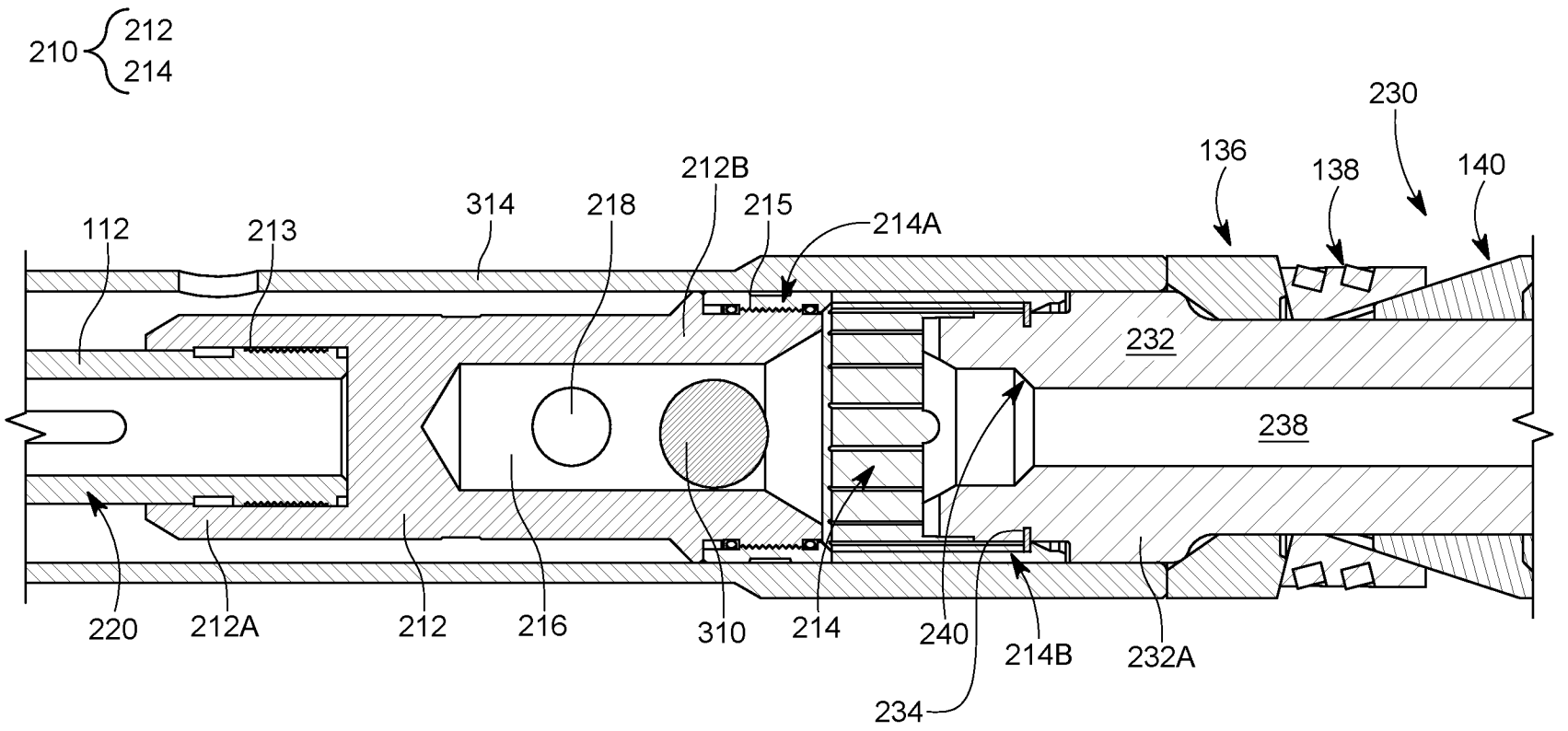
FIG. 3 illustrates the setting kit that automatically connects to a ring of the plug by only pushing the setting kit into the plug.
Figure 4A:
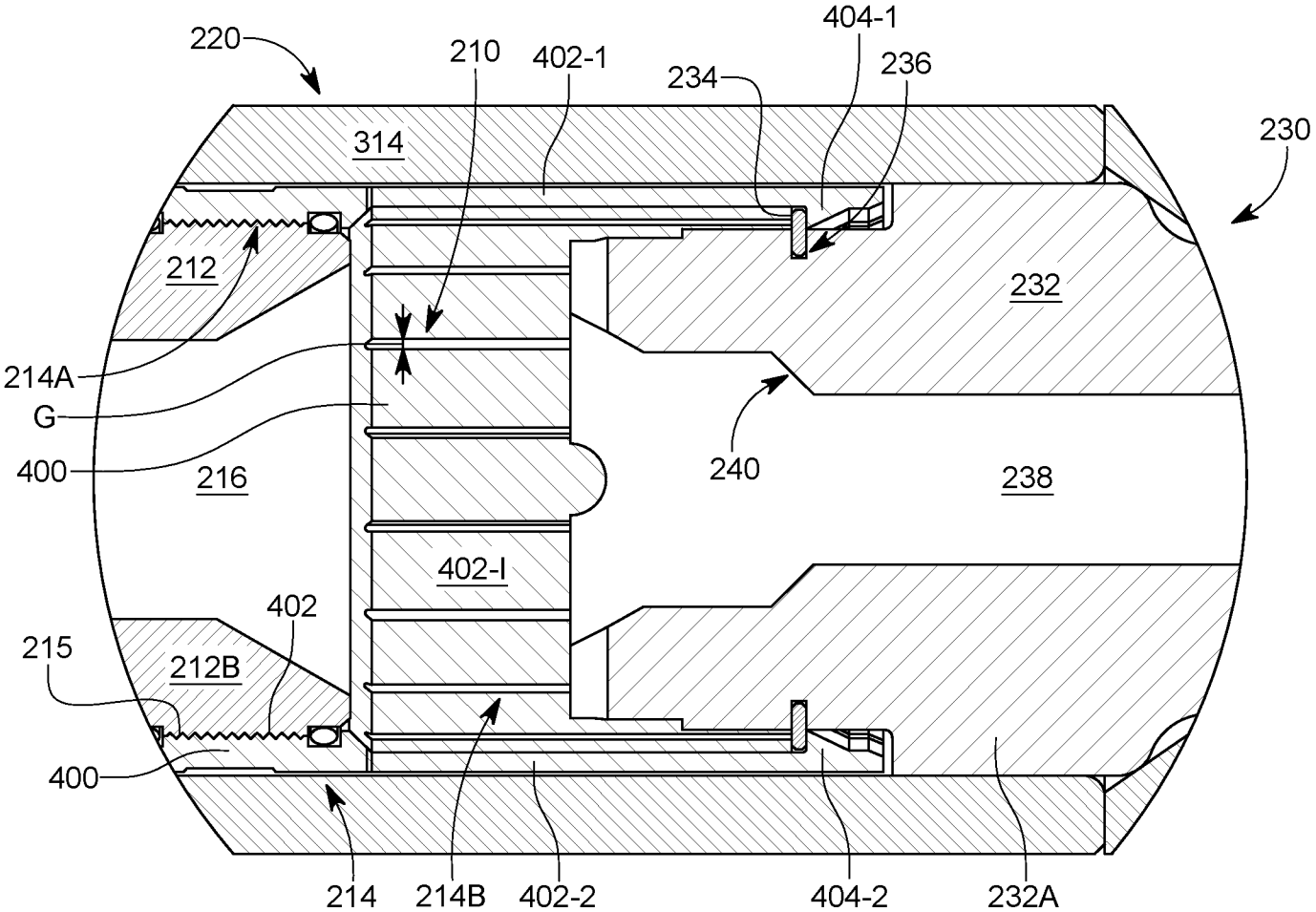
FIG. 4A illustrates a plug that has a groove in which the ring is placed for being connected to the setting kit.

FIG. 3 shows in more detail the setting kit 210 and its functional relationships to the setting tool 220 and the plug 230. While the external elements of the plug 230 may be similar to those of the plug shown in FIGS. 1A and 1B, its internal mandrel 232 is configured to have a head portion 232A, which is proximal to the setting kit 210, and this head portion is different from the head of the mandrel 132. More specifically, as shown in FIG. 3, the head 232A of the mandrel 232 has, in one application, a ring 234 formed around an entirety of the head. The ring 234 may be formed of various materials, e.g., metal, plastic, elastomer, etc. In one application, as shown in FIG. 4A, the ring 234 is manufactured separately from the plug 230. A corresponding trench 236 is formed in the head 232A of the mandrel 232 and the ring 234 is placed, partially, as shown in the figure, inside the trench 234. This means that part of the ring 234 extends around and away from the head 232A of the mandrel 232.

Figure 4B:
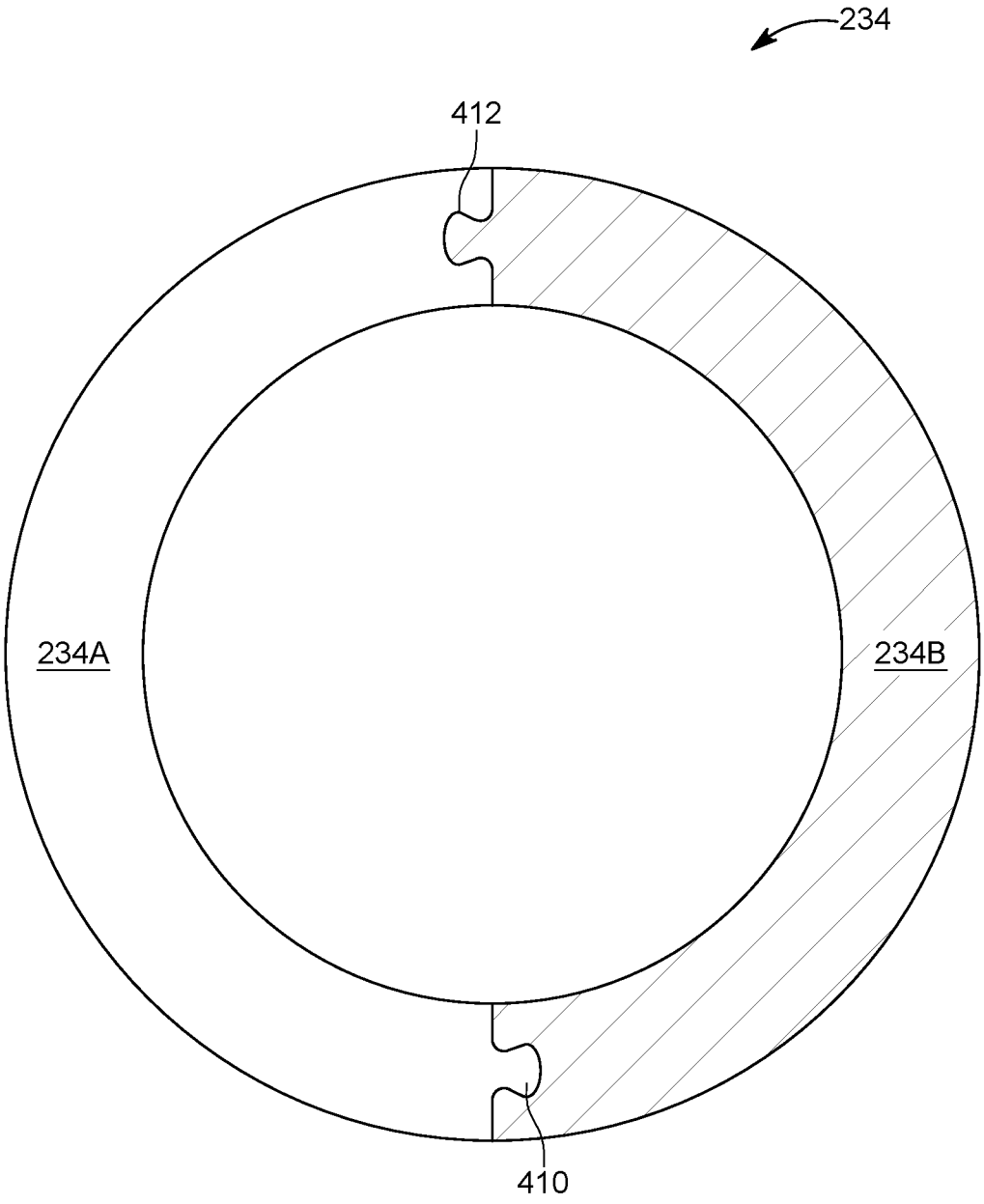
FIG. 4B illustrates the ring being made of two parts that connect to each other with male/female features.

In one application, the ring 234 may be made from two or more parts 234A and 234B, as shown in FIG. 4B. The two parts may be formed to have male 410 and female 412 features that fit into each other so that the two halves 234A and 234B shows in the figure can lock together. More than two parts may be used to form the ring 234. The ring may be formed of the same material as the mandrel 232 or a different material. When the parts 234A and 234B are locked together and placed in the trench 236, they will not separate from each other.

Figure 5:
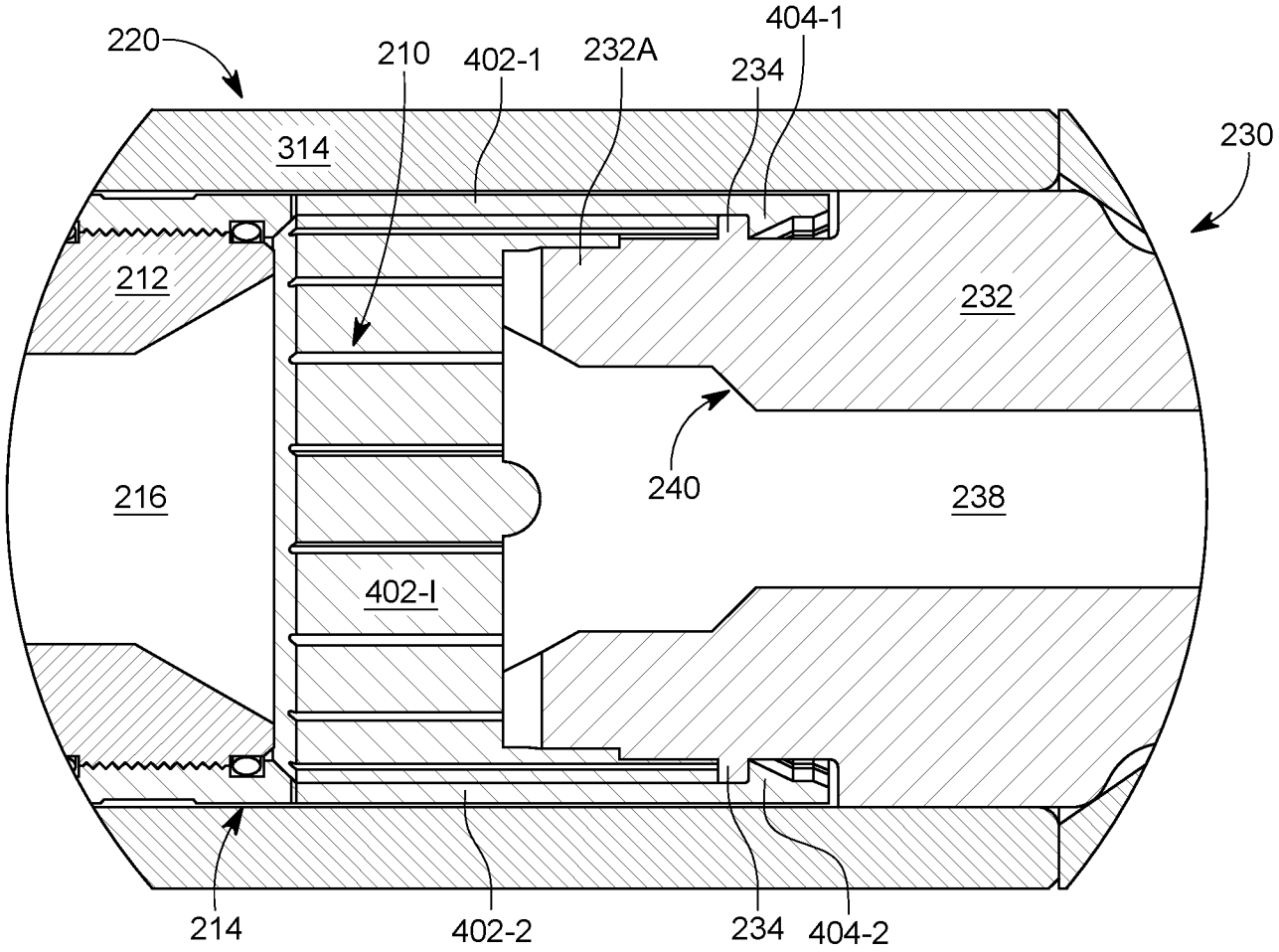
FIG. 5 illustrates a plug that has the ring formed integrally with a mandrel of the plug for being connected to the setting kit.

Alternatively, as shown in FIG. 5, the ring 234 may be made integrally with the head 232A of the mandrel 232, i.e., to have a monolithic structure. This means that both the mandrel 232 and the ring 234 are made of the same material, for example, during the same manufacturing process. If the mandrel 232 is made of a composite material, the ring 234 may be made by over-molding during the manufacturing of the mandrel. Any other process may be used for forming the ring 234 on the mandrel 232. It is noted that irrespective of the implementation of the ring 234 on the mandrel 232, the ring 234 is designed to not slide relative to the mandrel 232, along a longitudinal axis of the plug. However, the ring 234 is designed to break when a certain force is applied, for example, 10,000 psi, to release the setting kit 210.

The connection between the setting kit 210 and the plug 230 is now discussed with regard to FIGS. 3 to 5. These figures show the setting kit 210 including, in addition to the external sleeve 314 and the collet connecting part 212, a collet 214. The collet connecting part 212, as shown in FIG. 3, is configured to have threads 213 at a first end 212A, that are configured to fit corresponding threads of the internal sleeve 122 of the setting tool 220. The second end 212B of the collet connecting part 212 also has threads 215, which are configured to connect to corresponding threads of the collet 214. Thus, the collet 214 is attached to the internal sleeve 112 of the setting tool 220, through the collet connecting part 212. The collet connecting part 212 may have an internal chamber 216 that holds a ball 310. The ball 310 is sized to fit and close the bore 238 of the mandrel 232. In other words, as shown in FIG. 3, an interior shoulder 240 of the mandrel 232 is sized to receive the ball 310, and to form a seat that together with the ball 310 seals the bore 238. However, the seat/shoulder 240 is sized to not let the ball 310 pass through the mandrel 232. The bore of the collet 214 is sized to allow the ball 310 to pass through. Returning to the internal chamber 216, it has one or more openings 218 for allowing a fluid to enter into or exit freely from the chamber.

The collet 214 is illustrated in more detail in FIGS. 4A and 5 and has a body 400 that includes threads 402 at a first end 214A. The threads 402 are configured to connect to the threads 215 of the collet connecting part 212. The other end 214B of the collet 214 is shaped as fingers 402-I, which are separated by each other by a corresponding gap G. Each finger 402-1 may have a corresponding tab 404-1, as shown in FIGS. 4A and 5, and the tab is configured to engage the ring 234 so that the collet 214 is fixedly and securely attached to the mandrel 232 of the plug 230 by only pushing the fingers over the ring. In other words, after the tabs 404-1 and 404-2 engage the ring 234, there is no need for any screw or additional devices or actions to secure the collet 214 to the plug 230. The collet may be made of any material. In one application, the collet is made of such a material that the fingers are flexible, i.e., when the tabs of the fingers engage the ring, the fingers bent upwards to embrace the head of the mandrel. Note that FIGS. 4A and 5 show only two fingers 402-1 and 402-2 with their corresponding tabs 404-1 and 404-2 being engaged to the ring 234. However, in one application, all the fingers have corresponding tabs and each tab engages the ring 234. The tabs and/or the ring are shaped and their material is selected in such a way so that a desired maximum force can be applied by the collet on the mandrel. If the force applied by the setting tool to the mandrel through the collet becomes larger than the desired maximum force, the ring 234 is expected to break and to release the tabs 404-I, so that the collet 214 can separate from the plug 230, the plug 230 remains set in place, and the setting tool with the collet connecting part 212 and the collet 214 can be retrieved from the well. In one application, the ring is exclusively part of the plug and the collet does not even directly contact or touch the plug 230, only the ring 234.

In this way, there are no holes made either in the mandrel of the plug or in the internal sleeve of the setting kit. After the setting tool 220 sets the plug 230, just the ring 234 of the plug 230 is broken to separate the two elements, no other component. This means that as soon as the setting tool 220 and the setting kit 210 are brought to the surface, there is no need to remove any screw, but simply a new plug 230 is attached to the collet 214 so that the tabs 404-I of the collet engage the ring 234 of the new plug and the connection between the plug and the setting tool is established. Because of this simplified connection process, the operator of the setting tool and plug cannot misconnect these elements as they cannot be connected in any other way. Also, the multiple use of the setting tool and the setting kit do not damage any of their components, as only the ring of the plug 230 is damaged in the process. Therefore, as long as a new plug 230 is provided, the system 200 can be used multiple times with the same setting tool and setting kit.

Figure 6:
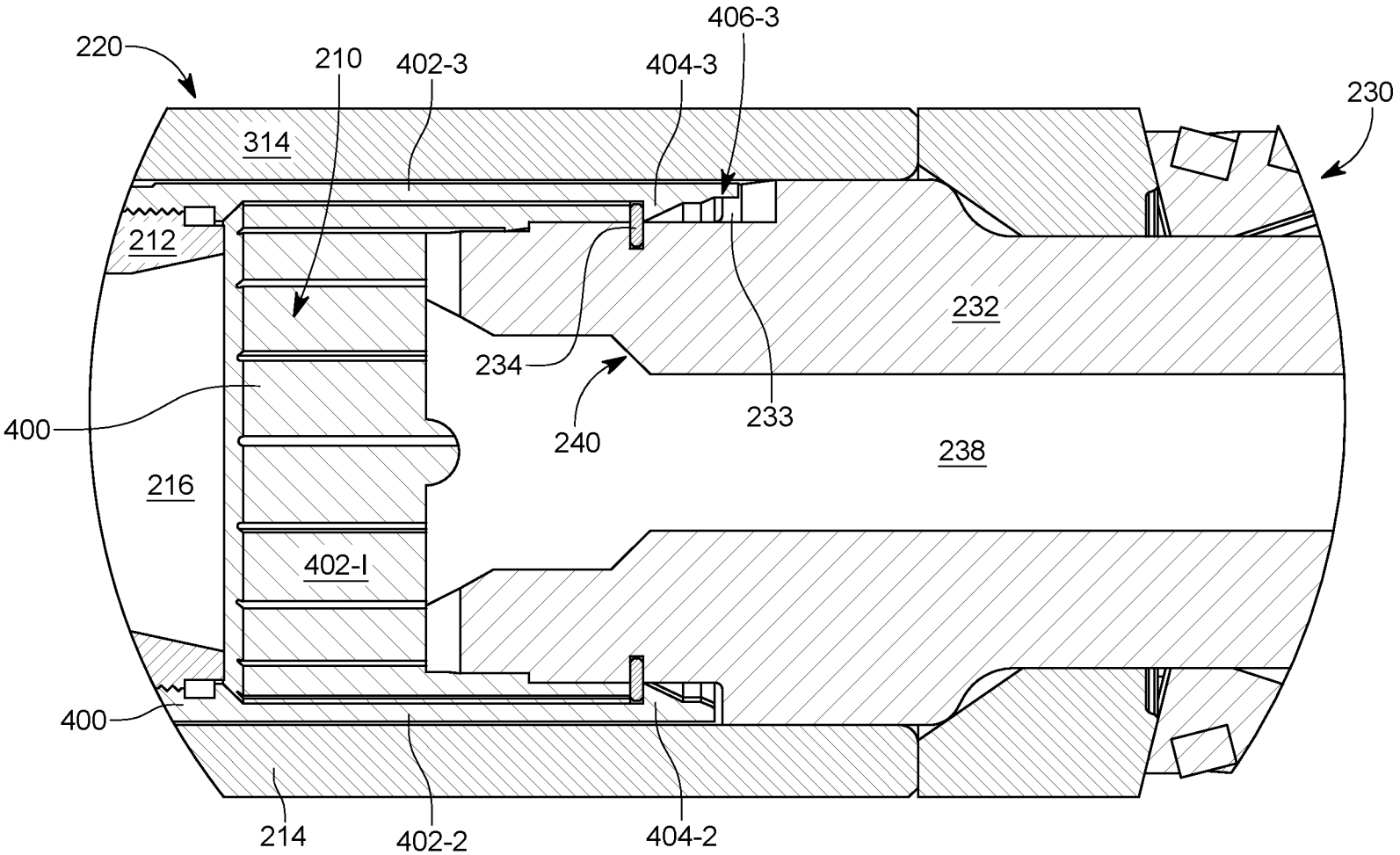
FIG. 6 illustrates the setting kit having a collet with plural fingers, and one finger is longer that the others for engaging a dedicated slot into the plug.

In one embodiment, which is illustrated in FIG. 6, one finger 402-3 has in addition to the corresponding tab 404-3, an extension 406-3, which is monolithically formed with the finger 402-3. The extension 406-3 makes the finger 402-3 to be longer than all other fingers 402-I. A corresponding longer slot 233 is formed in the head 232A of the mandrel 232, to accommodate this extension. This means that when the operator of the setting tool connects the plug 230 to the collet 214, the plug needs to be rotated so that the longer slot 233 matches and receives the extension 406-3 of the finger 402-3. Therefore, the plug can be added to the collet only if their angular orientations are aligned, i.e., the longer slot 233 acts as a key. In this way, after the collet is mechanically connected to the plug, the plug and the collet rotate as a single element, i.e., the plug cannot rotate relative to the collet. This feature ensures that the collet connecting part 212 also rotates with the plug, and thus, when the collet connecting part 212 is attached to the internal sleeve 112 of the setting tool 220, by rotating the plug, the collet connecting part also rotates and engages the threads 213. In this respect, note that the collet connecting part 212 is fully disposed inside the external sleeve 314.

In another embodiment, the setting kit may use a reversed tabbed collet where the tabs stick outward rather than inward and thus the collet bends in instead of out, i.e., the tabs and the fingers enter inside the mandrel to engage the ring or a corresponding structure, for example, a trench, which this time are formed inside the mandrel. Also, a spring and ball bearing connection can be used in one application for connecting the collet to the mandrel. A connection via a J-lock could also work to hook up a setting adapter to a frac plug to be set in the well.

The above discussed systems prevent any deviation from a standard procedure of assembly of the setting tool to a plug, at the well site. This approach reduces misruns due to the assembly at the well site where screws can be left out of the plug, thus causing a low set force and an improper seal of the well. In one application, the system 200 is faster and easier to assemble, leaves less hard metal in the well, as all that is left behind is a thin soft metal ring. In yet another application, the system 200 improves the tool life and longevity of the tool with the replaceable collet. The two piece shear ring shown in FIG. 4B overcomes the challenge of having a single shear ring over molded in a large horizontal mold.

Figure 7:
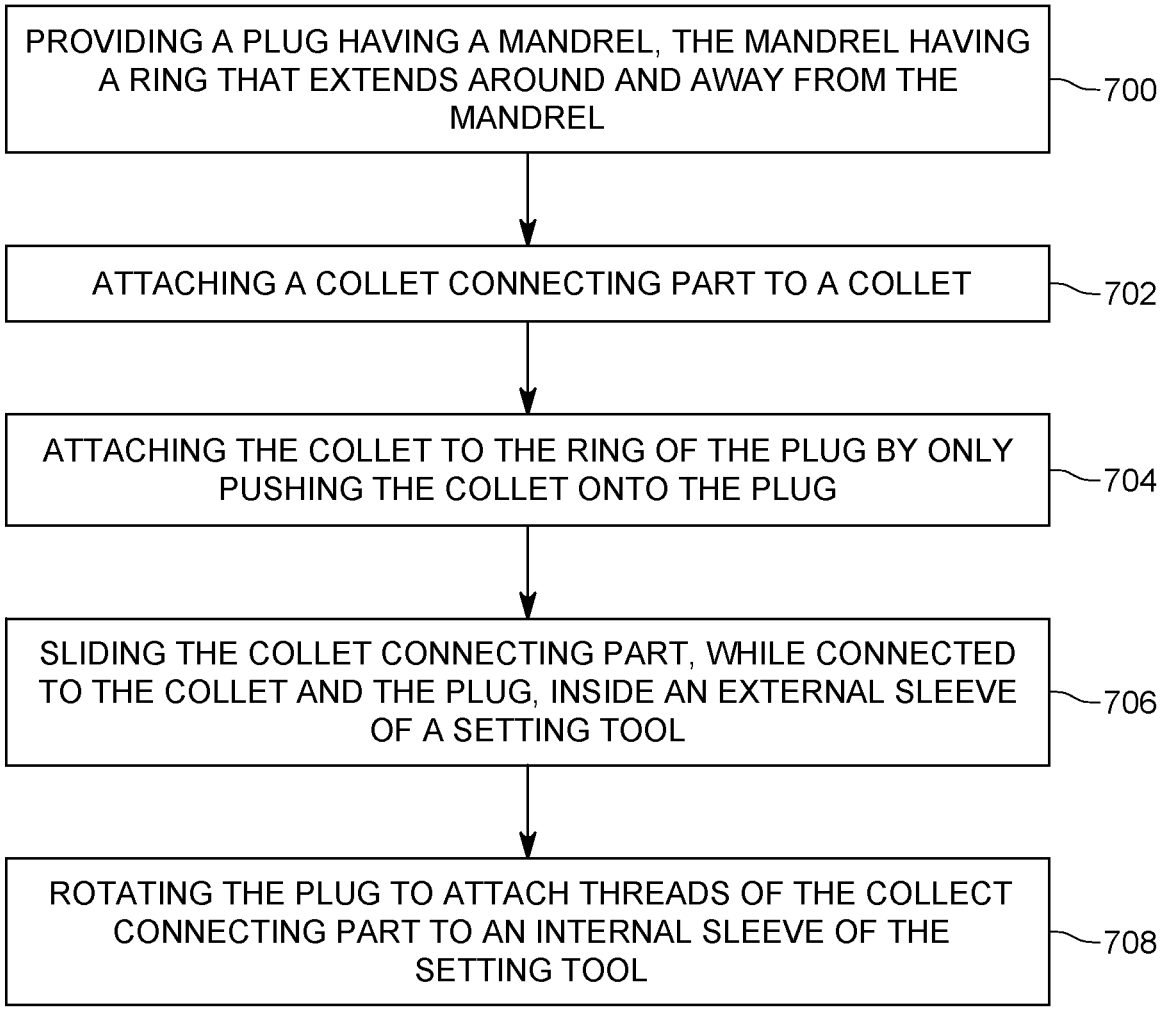
FIG. 7 is a flow chart of a method for automatically attaching the setting tool to the plug with the setting kit.

A method for attaching the plug to a setting tool is now discussed with regard to FIG. 7. The method includes a step 700 of providing a plug 230 having a mandrel 232, the mandrel 232 having a ring 234 that extends around and away from the mandrel 232, a step 702 of attaching a collet connecting part 212 to a collet 214, a step 704 of attaching the collet 214 to the ring 234 of the plug 230 by only pushing the collet 214 onto the plug 230, a step 706 of sliding 706 the collet connecting part 212, while connected to the collet 214 and the plug 230, inside an external sleeve 114 of a setting tool 220, and a step 708 of rotating the plug 230 to attach threads of the collect connecting part 212 to an internal sleeve 112 of the setting tool 220.

The disclosed embodiments provide methods and systems for connecting a plug to a setting tool with no screws. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A system for connecting a plug to a setting tool with a setting kit, the system comprising:

the plug, which is configured to seal a bore of casing in a well, and comprises a ring disposed on an outer surface of the plug and configured to break at a desired force; and the setting kit, wherein the setting kit has a collet comprising inwardly biased fingers that automatically engages and locks onto the plug by only pushing the collet onto the plug such that the inwardly biased fingers pass over the ring, such that application of the desired force frees the setting kit from the plug, and wherein the setting kit is configured to attach to an internal sleeve of the setting tool.

2. The system of claim 1, further comprising:

a collet connecting part configured to be attached to the internal sleeve of the setting tool; and an external sleeve configured to house the collet connecting part, wherein the collet is configured to be attached with a first end to the collet connecting part and with a second end to the plug.

3. The system of claim 1, wherein the collet has plural fingers at the second end, and each finger engages the ring.

4. The system of claim 3, wherein each finger has a tab which is configured to move past the ring and lock the tab onto the ring.

5. The system of 4, wherein at least one finger of the plural fingers has an extension that extends past the corresponding tab.

6. The system of claim 1, wherein the ring is molded into a mandrel of the plug.

7. The system of claim 1, wherein the ring is placed into a trench formed in a mandrel of the plug.

8. The system of claim 2, further comprising:

a ball, wherein the collet connecting part has an internal chamber configured to hold the ball and the ball is sized to pass through an internal bore of the collet.

9. A method for connecting a plug to a setting tool before being deployed in a well, the method comprising:

providing a plug having a mandrel, the mandrel having a ring that extends around and away from the mandrel and is configured to break at a desired force;

attaching a collet connecting part to a collet comprising inwardly biased fingers;

attaching the collet to the ring of the plug by only pushing the collet onto the plug such that the inwardly biased fingers pass over the ring;

sliding the collet connecting part, while connected to the collet and the plug, inside an external sleeve; and rotating the plug to attach threads of the collet connecting part to an internal sleeve of the setting tool.

10. The method of claim 9, further comprising deploying the combination of the setting tool and plug in a well.

11. The method of claim 10, further comprising exerting the desired force on the ring, such that the setting kit is freed from the plug.

12. The method of claim 11, further comprising deploying a ball in the wall, wherein the ball is sized to pass through an internal bore of the collet.

13. The method of claim 12, wherein the collet connecting part has an internal chamber configured to hold the ball.

* * * * *